US007510457B2

(12) United States Patent
Hussa-Lietz

(10) Patent No.: US 7,510,457 B2
(45) Date of Patent: Mar. 31, 2009

(54) METHOD OF CONSTRUCTING A THREE-DIMENSIONAL STRUCTURE WITH A MULTI-PART CONSTRUCTION TOY SET

(75) Inventor: Kyle Philip Hussa-Lietz, Wilkes-Barre, PA (US)

(73) Assignee: K'Nex Limited Partnership Group, Hatfield, PA (US)

( * ) Notice: Subject to any disclaimer, the term of this patent is extended or adjusted under 35 U.S.C. 154(b) by 554 days.

(21) Appl. No.: 11/049,809

(22) Filed: Feb. 3, 2005

(65) Prior Publication Data

US 2006/0172656 A1 Aug. 3, 2006

(51) Int. Cl.
*A63H 33/04* (2006.01)

(52) U.S. Cl. ..... 446/85; 446/476; 446/487; 424/79

(58) Field of Classification Search ..... 446/85, 446/476, 487, 488, 478; 273/157 R; 434/79
See application file for complete search history.

(56) References Cited

U.S. PATENT DOCUMENTS

| | | | | |
|---|---|---|---|---|
| 2,871,619 | A * | 2/1959 | Walters | 446/110 |
| 4,047,322 | A * | 9/1977 | Keisling | 434/403 |
| 5,251,900 | A * | 10/1993 | Gallant | 273/157 R |
| 5,470,410 | A | 11/1995 | Keating et al. | |
| 5,601,431 | A * | 2/1997 | Howard | 434/79 |
| 5,733,612 | A | 3/1998 | Garry | |
| 5,791,647 | A * | 8/1998 | Reiling | 273/157 R |
| 5,846,084 | A * | 12/1998 | Volpe Prignano | 446/118 |
| 6,015,150 | A * | 1/2000 | Giguere | 273/157 R |
| 6,089,941 | A | 7/2000 | Glickman et al. | |
| 6,217,336 | B1 | 4/2001 | Matthews | |
| 6,554,675 | B1 | 4/2003 | Nyengaard | |
| 6,669,486 | B2 | 12/2003 | Frankenbery et al. | |
| 6,857,633 | B1 * | 2/2005 | Mackey | 273/156 |
| 2003/0175669 | A1 | 9/2003 | Mimlitch, III et al. | |
| 2003/0234488 | A1 | 12/2003 | Povitz | |

FOREIGN PATENT DOCUMENTS

| | | | |
|---|---|---|---|
| FR | 2570614 A | * | 3/1986 |
| GB | 370576 | | 4/1932 |

OTHER PUBLICATIONS

Kid K'Nex Classroom Collection, Part #78690, p. 2.

* cited by examiner

*Primary Examiner*—Gene Kim
*Assistant Examiner*—Urszula M Cegielnik
(74) *Attorney, Agent, or Firm*—Schweitzer Cornman Gross & Bondell LLP

(57) ABSTRACT

A method for constructing three-dimensional structures with a multi-part construction toy comprised of connectable component parts. A flat construction plan is provided illustrating in full size a two-dimensional structure constituting all or a large part of the intended three-dimensional structure. The connectable component parts are placed directly over their respective illustrations on the flat plan, and joined to form the two-dimensional structure. The two-dimensional structure may include a pair of opposite side subassemblies joined by one or more reorientable bridging elements, for example a flexible panel. After completion, the two-dimensional structure is picked up and erected to three-dimensional form by bending or pivoting the bridging element to position the opposite side subassemblies in spaced apart, usually parallel relation. The free ends of the subassemblies are then joined, usually by a bridging element, which may form an end element of the two-dimensional structure. Where desired, additional bridging components can be added to rigidify and embellish the initially formed three-dimensional structure.

3 Claims, 10 Drawing Sheets

METHOD OF CONSTRUCTING A THREE-DIMENSIONAL STRUCTURE WITH A MULTI-PART CONSTRUCTION TOY SET

BACKGROUND OF INVENTION

Multi-part construction toy sets, such as K'NEX, are widely used by young children to build various three-dimensional models and structures using various rods, connectors and other components that are connected together. The K'NEX construction toy set, for example, utilizes a variety of rods and connectors arranged to be joined by a unique lateral snap-in connection in order to be able to assemble a rigid three-dimensional structure. Typically, such construction toy sets are sold with diagrammatic illustrations showing progressive steps of assembly of a particular model, such that the user, following an illustrated progression of assembly steps, can select and assemble the appropriate components to achieve the desired model or structure. As the assembly progresses, the three-dimensional structure progressively and incrementally advances step by step through the instruction sequence to achieve the final assembly.

SUMMARY OF THE INVENTION

The present invention provides a novel and improved procedure for greatly simplifying and expediting the construction of a three-dimensional structure by enabling a substantial portion of the structure to be assembled in two-dimensional form and then erected to a three-dimensional form. The initial assembly in two-dimensional form is far simpler and more expeditious than assembling in three-dimensional form in the first instance, and is much easier for younger users in particular to accomplish. The procedures of the invention are particularly useful and advantageous in connection with K'NEX multi-part construction toys, but the invention is not necessarily limited thereto.

In an advantageous form of the invention, an assembly diagram or construction plan is provided which illustrates the entire two-dimensional structure which is to be assembled and erected, such that the user may, with a single diagram, assemble all of the components required to complete the two-dimensional, erectable unit. To particular advantage, the construction plan is illustrated in full size, so that the appropriate component parts may be placed directly on top of corresponding illustrations on construction plan as the assembly proceeds. The individual components are illustrated on a one-to-one size relationship with the actual components to be assembled and the illustrations desirably include appropriate coloration so that the user is greatly facilitated in selecting component parts by size, shape and color.

In a particularly advantageous embodiment of the invention, a full-size, two-dimensional plan is provided, which is laid out flat on a building surface. The two-dimensional plan illustrates in full size an assembly comprising, in two-dimensional form, opposite side subassemblies of a three-dimensional structure joined together in a manner that enables the two-dimensional form to be erected into three-dimensional configuration, with opposite side subassemblies being spaced apart and (typically but not necessarily) parallel. To greatest advantage, the two opposite side subassemblies are joined by one or more bridging members which can be flexible elements (e.g., rods or panels), or hinged connections. This enables the two-dimensional structure to be "folded" through the medium of the flexible or hinged connecting element(s) to position the opposite side subassemblies in the desired spaced apart manner to establish a three-dimensional form. Desirably, although not necessarily, the two-dimensional structure includes a further bridging member, again a flexible or hinged element attached to one end of the two-dimensional assembly. When the assembly is erected into a three-dimensional configuration, the additional bridging element can be connected from one side subassembly to the other, such that the three-dimensional erected structure has a closed configuration.

In its most primitive form, the procedure of the invention can provide a completed three-dimensional structure upon merely erecting the structure to three-dimensional form and connecting the two opposite side subassemblies together at their free ends, as above described. More typically, however, more complex structures are desired, and additional structural elements are incorporated into the three-dimensional structure, both to rigidify the structure and add features thereto, as desired.

For a more complete understanding of the above and other features and advantages of the invention, reference should be made to the following detailed description of a preferred embodiment thereof, and to the accompanying drawings.

DESCRIPTION OF THE DRAWINGS

FIG. 5 illustrates the structure as erected to a three-dimensional form, with opposite side subassemblies positioned in spaced apart, generally parallel relation.

DESCRIPTION OF A PREFERRED EMBODIMENT

Figure 1:
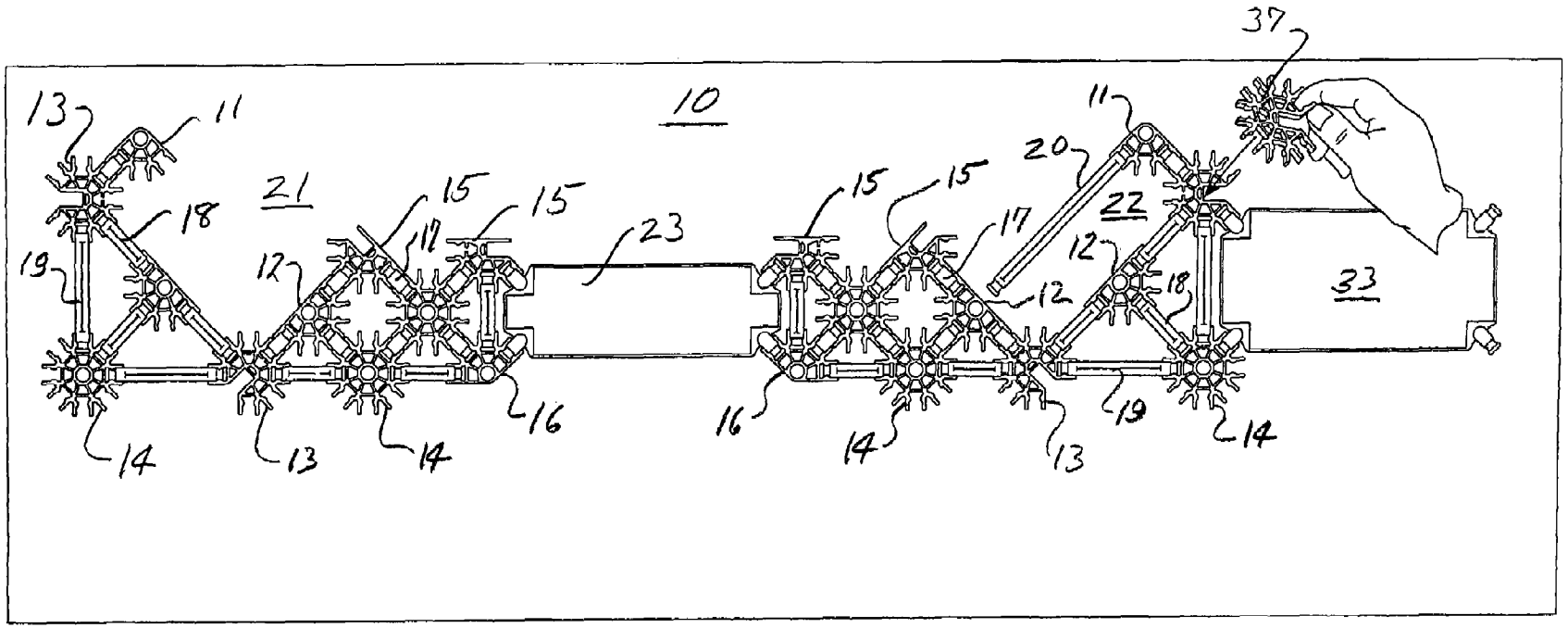
FIG. 1 is a plan view of a two-dimensional construction plan according to the invention, laying out in full size, a two-dimensional structure convertible to three-dimensional form after completion.

Referring now to the drawings, the reference numeral 10 (FIG. 1) designates generally a flat construction plan for constructing a two-dimensional structure in accordance with the invention. The illustrated form of construction plan is designed specifically for a construction toy of the type marketed under the K'NEX trademark by K'NEX Industries, Inc., Hatfield, Pa. However, as will be understood and will be evident upon further review of the specification, the underlying principles of the invention can be applied advantageously to other types of construction toys.

In order to best understand the invention, reference may be made to certain earlier patents directed to the K'NEX construction toy system and illustrating specific details of rod and connector elements utilized therein. In particular, reference can be made to the Glickman U.S. Pat. Nos. 5,061,219 5,137,486, 5,199,919, the disclosures of which are hereby incorporated herein by reference.

In the flat construction plan 10 there is shown a plan for a two-dimensional assembly that, after completion, can be erected into three-dimensional form. The device specifically illustrated in the plan 10 is a motor vehicle. However, the principles of the invention are in no way limited to such objects and can be applied to a great variety of structures.

Figure 2:
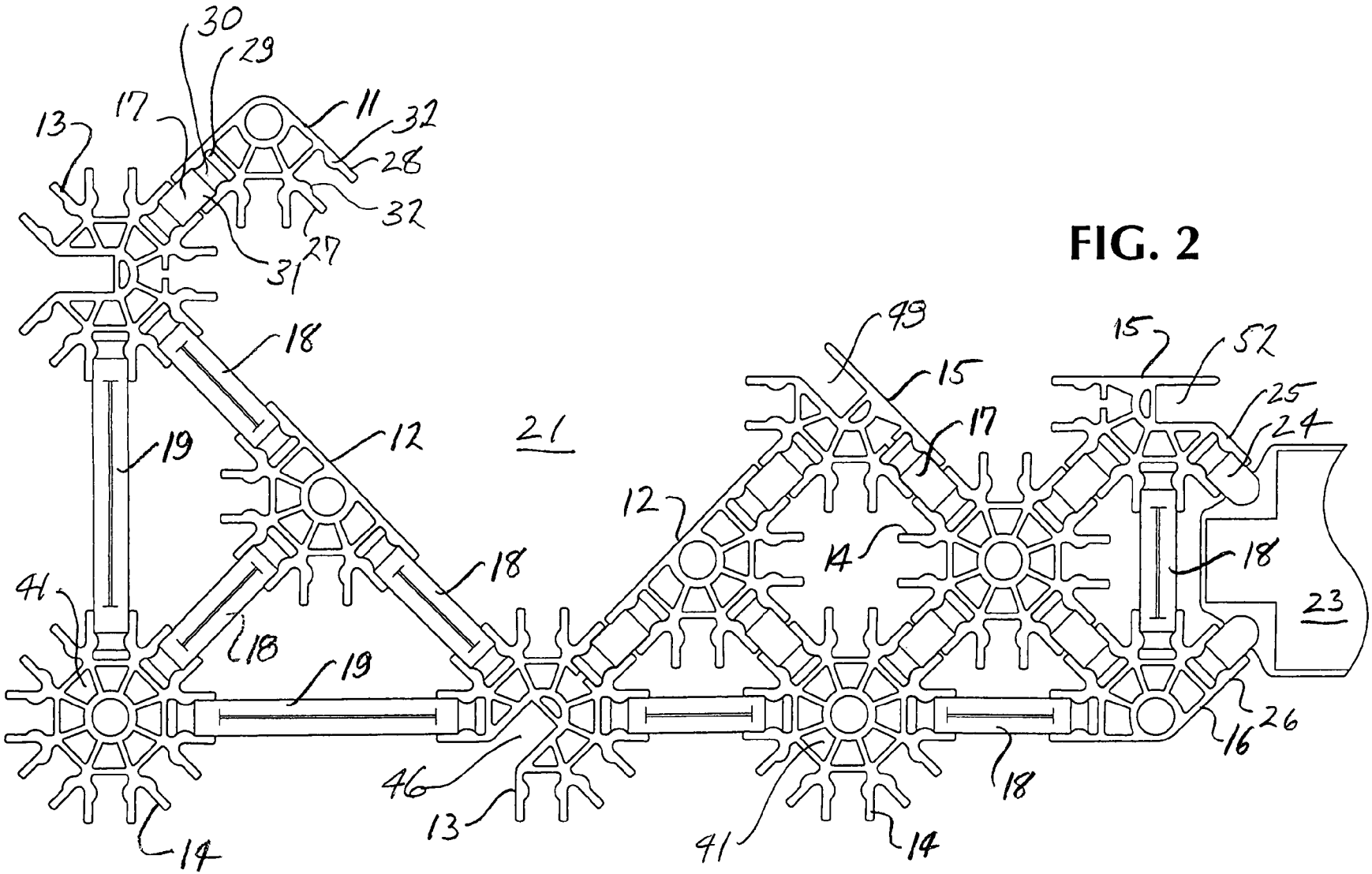
FIGS. 2 and 3 are enlarged views illustrating a two-dimensional structure assembled on the construction plan of FIG. 1.
Figure 3:
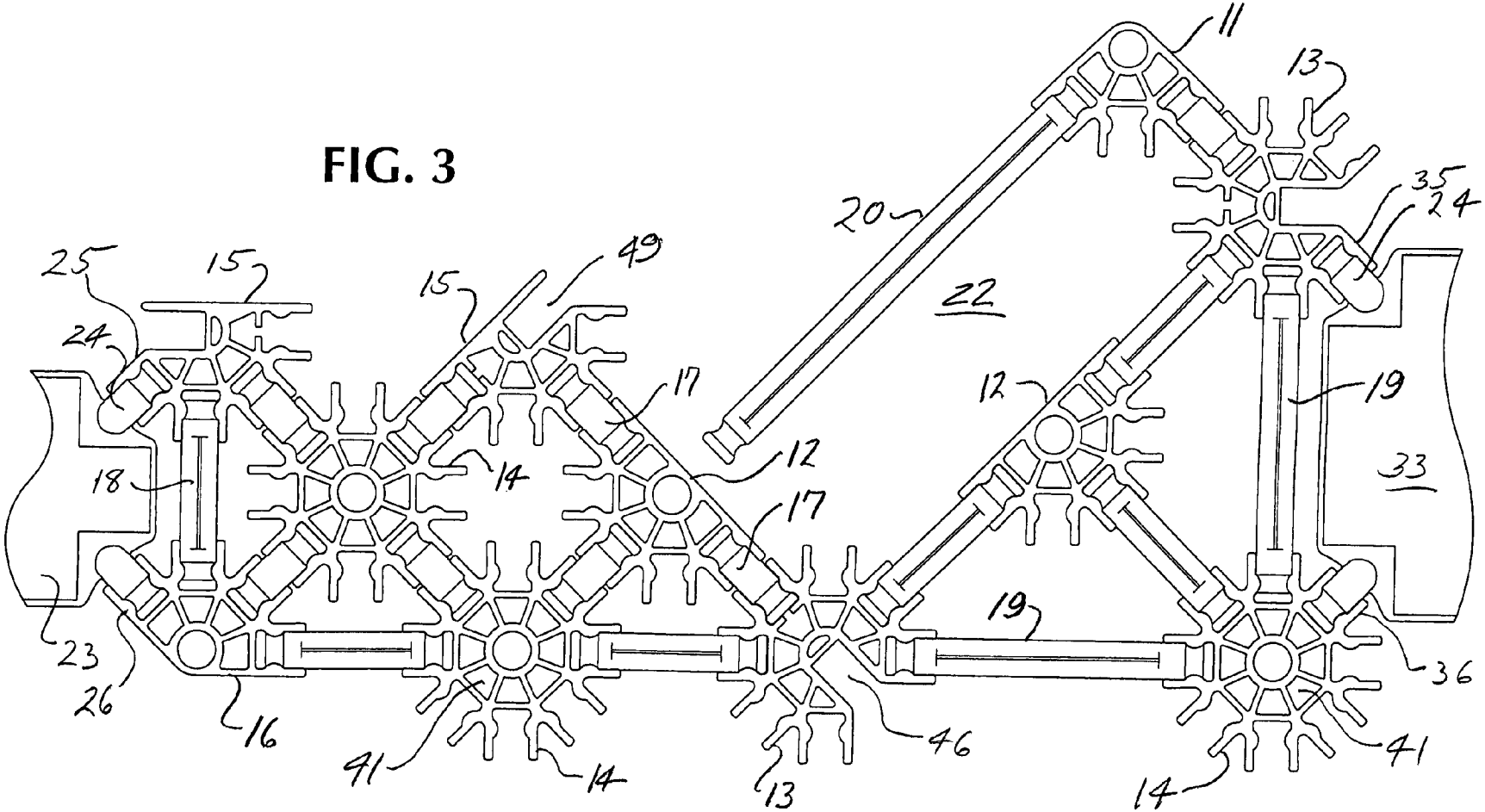

Whereas FIG. 1 illustrates a plan for a two-dimensional structure, FIGS. 2 and 3 together illustrate the structure itself, after completion in two-dimensional form. In the initial portion of this description, there will be more or less interchangeable reference between FIG. 1 and FIGS. 2 and 3.

In the plan 10, there are illustrated a number of different forms of connectors 11-16. Where the same connector appears more than once in the plan, it is assigned the same reference numeral in all instances. Likewise, in the structural illustration of FIGS. 2 and 3, the connectors have been assigned the same reference numerals as the illustrations thereof in FIG. 1, for convenience. In FIG. 1, the rod elements of the plan are illustrated in four different sizes 17-20, from shortest to longest. The lengths of the respective rods 17-21 is in accordance with a specific progression described in the before mentioned Glickman patents, to enable rods and connectors to assembled in the form of isosceles right triangles of various sizes.

In the illustrated plan of FIG. 1, the construction diagram illustrates first and second subassemblies 21, 22 which can be generally identical in structure and, in the illustration, are intended to form opposite side structures of a vehicle. The front portions of the respective subassemblies 21, 22 face each other and, in the construction plan of FIG. 1, are to be joined by a bridging element 23 which, in the illustrated embodiment is a flexible panel formed of a tough but bendable plastic material, such as PVC. The component which comprises the panel 23 includes rod-shaped projections 24 which extend outwardly at 45 degrees from the principal axes of the flexible panel and are adapted for lateral, snap-in reception in sockets 25, 26 of connector elements 15, 16 located at the front end of each of the opposite side subassemblies 21, 22.

It will be understood that the various rods and connectors, and the rod ends 24 of the panel 23, are all formed in accordance with the principles described in the before mentioned Glickman U.S. patents. Thus, each of the sockets of the connectors 11-16 comprises a pair of spaced apart gripping arms 27, 28 (see connector 11 at the upper lift in FIG. 2). The outer portions of these gripping arms are grooved in the axial direction, in order to grip and hold the end portion of a rod 17-20. Each of the rods is formed with an end flange 29 and an annular groove 30 adjacent to the end flange. A portion 31 of the rod immediately adjacent to the annular groove 30 is of cylindrical form for engagement with the axial grooves in the outer portions of the gripping arms 27, 28. The rod portions are engaged with the connector sockets by being pressed laterally into the sockets. The grooved portions of the gripping arms allow a lateral snap-in assembly, after which the rod is firmly gripped by its cylindrical portion 31. Projecting ribs 32 in each of the connector sockets engage the annular grooves 30 to lock the rods against axial movement in the socket. The advantageous functioning of the rods and connectors is described in more detail in the before mentioned Glickman patents.

As reflected in FIGS. 2 and 3, the geometry of the rod ends 24 of the flexible panel 23 is such that the rod ends are engaged by lateral snap-in engagement with the sockets 25, 26 of connectors 15, 16 at the front of the respective opposite side subassemblies 21, 22.

To advantage, a second bridging element 33, a flexible panel in the illustrated embodiment (see FIGS. 1 and 3), is attached to the back end portion of one of the subassemblies 21, 22. The flexible panel 33 is formed of relatively stiff plastic, such as PVC, but can be flexed and bent into a somewhat U-shaped configuration, as will appear. The second bridging element 33, as the first element 23, is provided with rod end elements 24 at each corner, arranged at a 45 degree orientation with respect to the principal horizontal and vertical axes of the panel. The rod ends 24 are adapted to be received in sockets 34, 35 in the respective upper and lower connectors 13, 14 positioned at the back end of the subassembly 22.

Pursuant to the invention, the construction plan 10 provides a complete illustration of an assembled two-dimensional structure, including all of the necessary rods and connectors and bridging elements to achieve a desired two-dimensional assembly. In a particularly preferred practice of the invention, the illustration of the construction plan includes all of the rods and connectors in full size, and preferably also in the same color as the components are provided in the construction toy set. Accordingly, the two-dimensional structure illustrated in the construction plan can be assembled by placing the physical components (see item 37 in FIG. 1) directly on top of the illustration in the construction plan of that component. Additionally, as is evident in FIG. 1, the physical component 37 can be readily oriented to match the orientation of the part in the construction plan.

The construction of the entire two-dimensional structure proceeds by placing components, corresponding to those illustrated, directly over their illustrated positions. Particularly with the K'NEX construction toy, for example, wherein rods are joined with connectors (and vice versa), by a lateral snap-in action, the components can be simply pressed downward toward the surface of the construction plan to effect the desired assembly of one component to its neighbor. Since the size, orientation and preferably even color of the components, is shown in the construction plan, it is very easy and efficient for the builder, particularly young children, to select the proper components and position them properly for an accurate assembly. An error in the selection and/or orientation of a component would be immediately evident as the builder attempted to place it on to the construction plan directly on top of the illustration.

Figure 4:
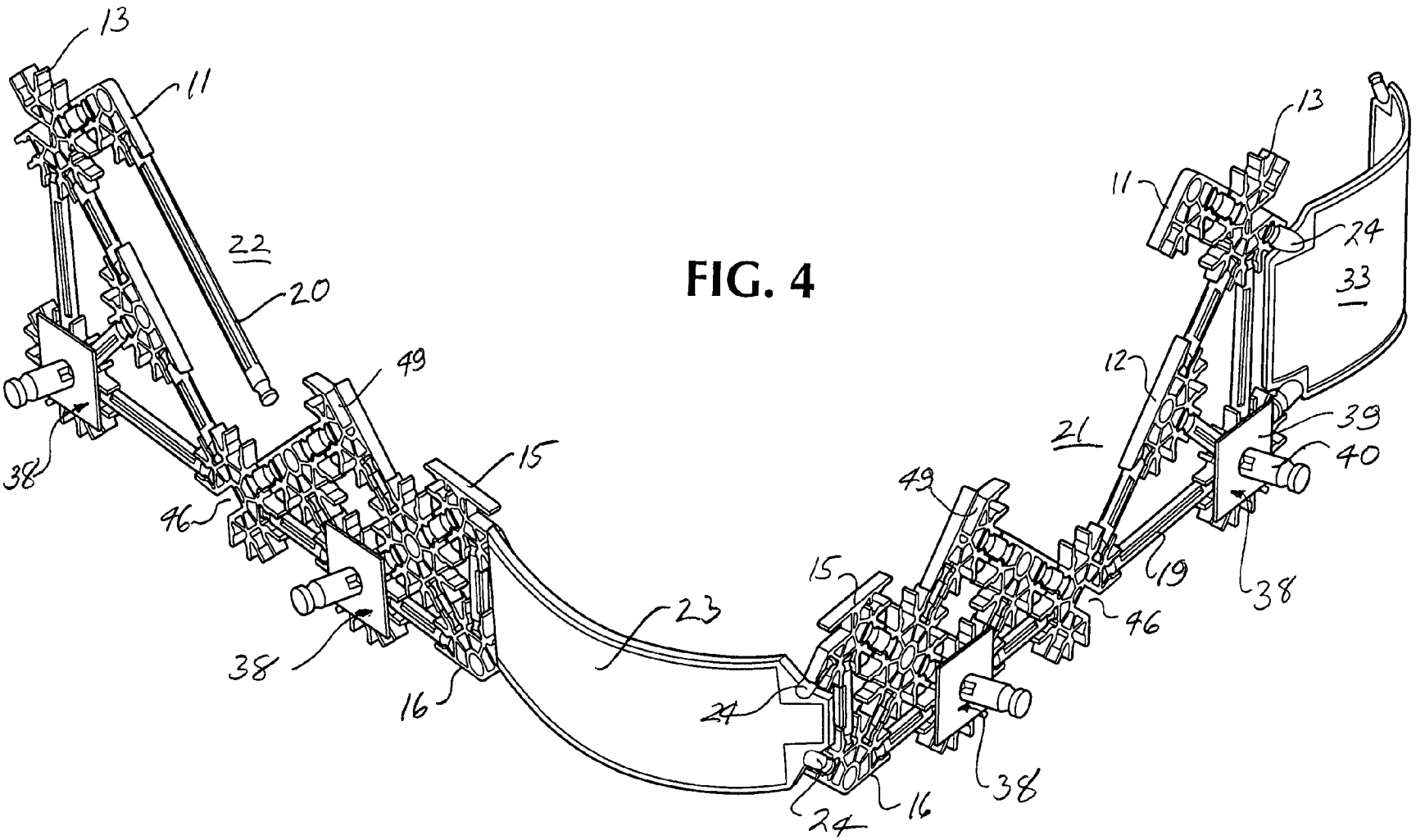
FIGS. 4 and 5 illustrate a step in erecting the two-dimensional structure of FIGS. 2 and 3 to a three-dimensional form.
Figure 5:
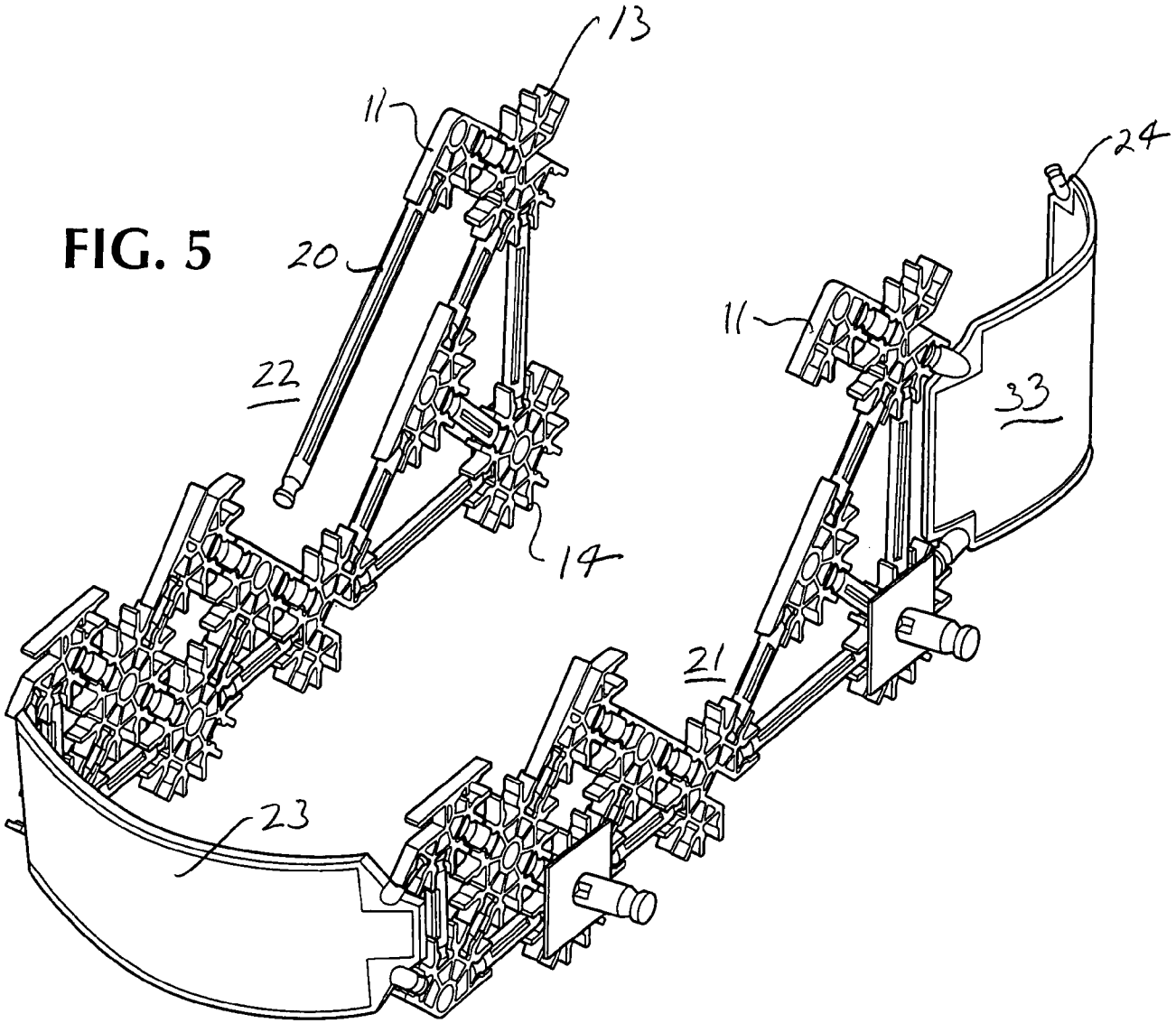

Construction proceeds until the entire two-dimensional structure shown in the construction plan has been completed. At that stage, the two-dimensional structure can be lifted off of the construction plan 10 and reoriented to bring the opposite side subassemblies 21, 22 into a vertical orientation. Thereafter, the two subassemblies are repositioned, as shown in FIGS. 4 and 5, until they are in a spaced-apart, generally parallel orientation. During this flexing or folding operation, the front flexible panel 23 flexes into a relatively shallow U-shaped configuration. The rod ends 24 at the four corners of the flexible panel 23 remain engaged by the respective upper and lower front connectors 15, 16, with the inner or base portions of the rods bending as part of the flexing action of the panel 23. The structure is now assuming a three-dimensional form.

Figure 6:
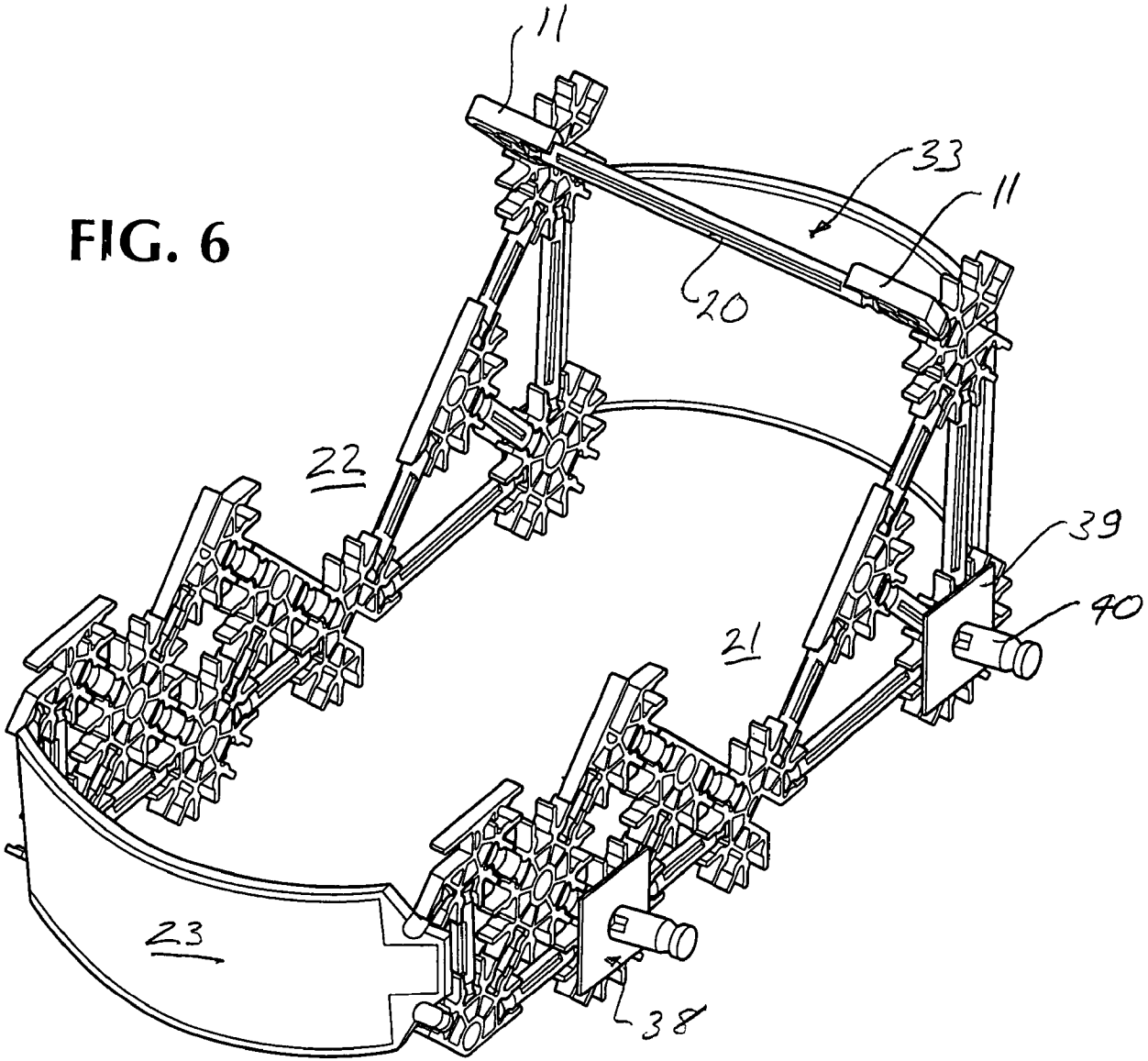
FIG. 6 illustrates the erected assembly of FIG. 5 with the free ends of the opposite side subassemblies connected.

As shown in FIG. 6, after the initial flexing operation has been carried out to the stage indicated in FIG. 5, the back flexible panel 33, which is already connected to the subassembly 21 is flexed into a shallow, U-shaped configuration and its free rod ends 24 are joined with sockets in the upper and lower connectors 13, 14 of the subassembly 22. Additionally, at this stage, the rod 20, which is carried by connector 11 at the back of subassembly 22, is pivoted upwardly and joined with a connector 11 at the back of subassembly 21, as shown in FIG. 6, to form a rigid connection.

The specifically illustrated structure, which is a vehicle, is provided with two wheel mounts 38 on each of the opposite side subassemblies 21, 22. The wheel mounts 38 comprise a base plate 39 from which extends an axle 40. On the back side of the base plate 39 (and not visible in the drawings) there are a plurality (typically four) lugs that are adapted to be received in openings 41 provided in the front and back lower connectors 14 (see FIGS. 2 and 3). The wheel mounts 38 optionally can be installed on to the two-dimensional structure as it is formed on top of the construction plan 10, or they can be inserted later, if desired, after the basic structure has been converted to a three-dimensional form, as shown in FIG. 6.

The structure shown in FIG. 6 is perhaps a basic form of a three-dimensional structure constructed in accordance with the invention. More typically, however, the basic structure is enhanced and embellished by the addition of other components, typically in the form of additional bridging elements that connect between the two opposite side subassemblies 21, 22 and serve, among other things, to strengthen and rigidify the three-dimensional structure.

Figure 7:
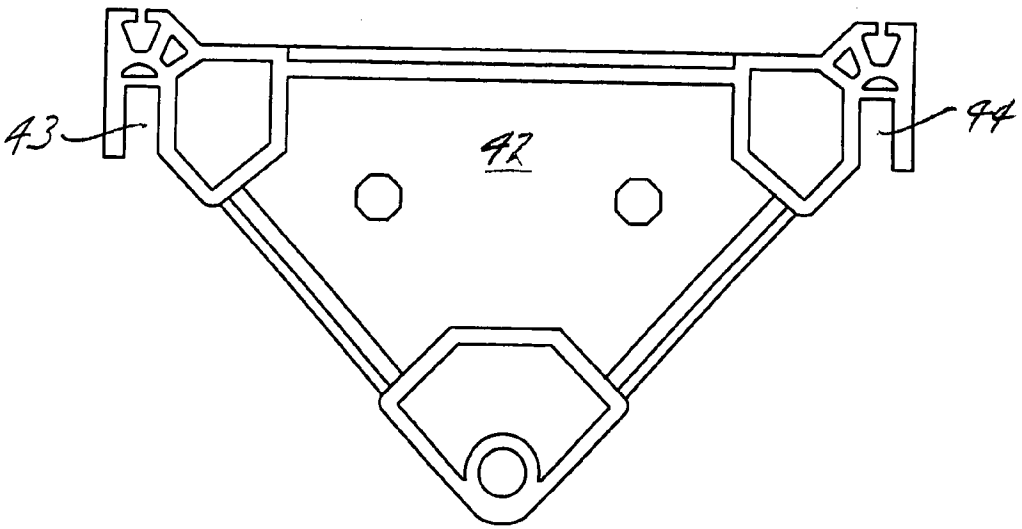
FIG. 7 is a top plan view of one form of bridging element advantageously used for rigidly connecting opposite side subassemblies of the three-dimensional structure of FIG. 6.
Figure 8:
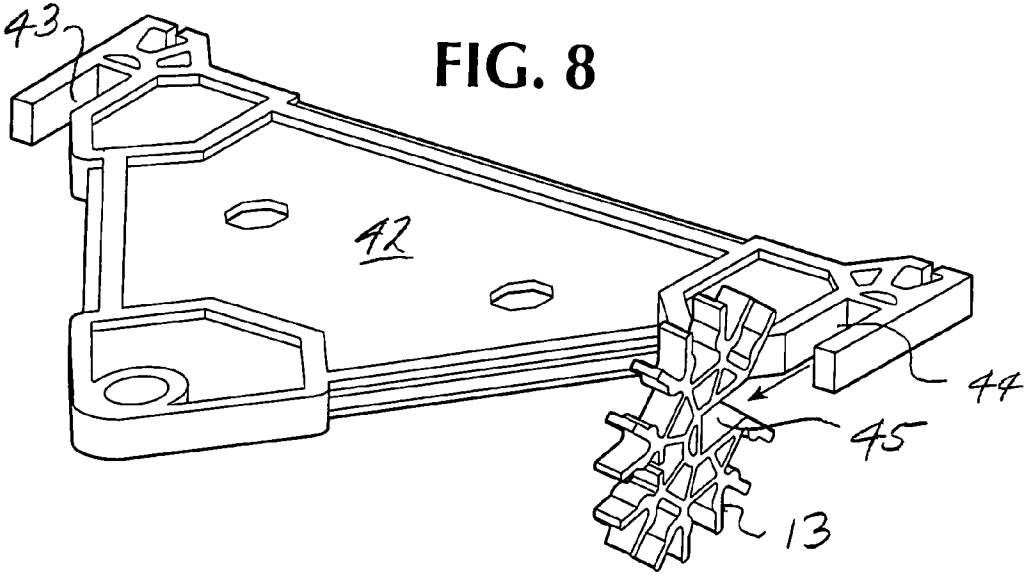
FIG. 8 is a perspective view of the bridging element of FIG. 7, illustrating the manner in which it is joined with a connector element of a K'NEX construction toy set.
Figure 9:
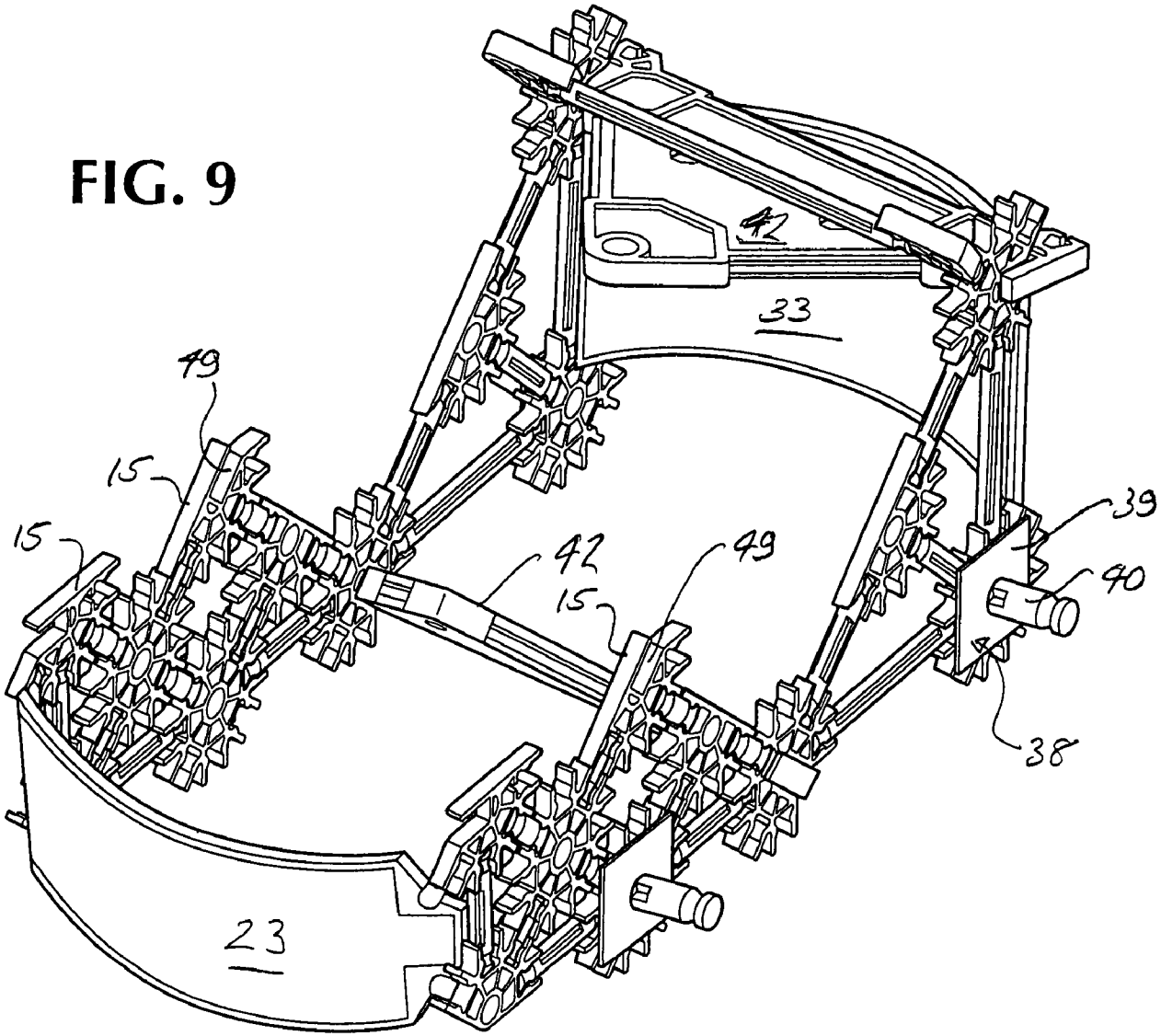
FIG. 9 is an illustration of the three-dimensional assembly of FIG. 6 after installation of bridging elements of FIGS. 7 and 8.

One advantageous form of additional bridging element is shown in FIGS. 7 and 8. This bridging element, identified by the reference numeral 42, is a rigid panel, formed of rigid plastic material, provided at opposite sides with recesses 43, 44 which are adapted to be slideably received within oppositely facing recesses of selected connector elements. One such bridging element 42 is received in recesses 45 of connectors 13 at the upper back of the respective subassemblies 21, 22. The manner of assembly is indicated in FIG. 8. When the bridging element 42 is fully seated in the upper back connectors 13, at the back of the three-dimensional structure, significant strength and rigidity is imparted to the back portion of the structure.

In the illustrated three-dimensional structure, a rigid bridging element 42 is inserted at an upward angle into recesses 46 in the lower connectors 13 in the mid portions of the respective subassemblies 21, 22 (FIGS. 2 and 3).

Figure 10:
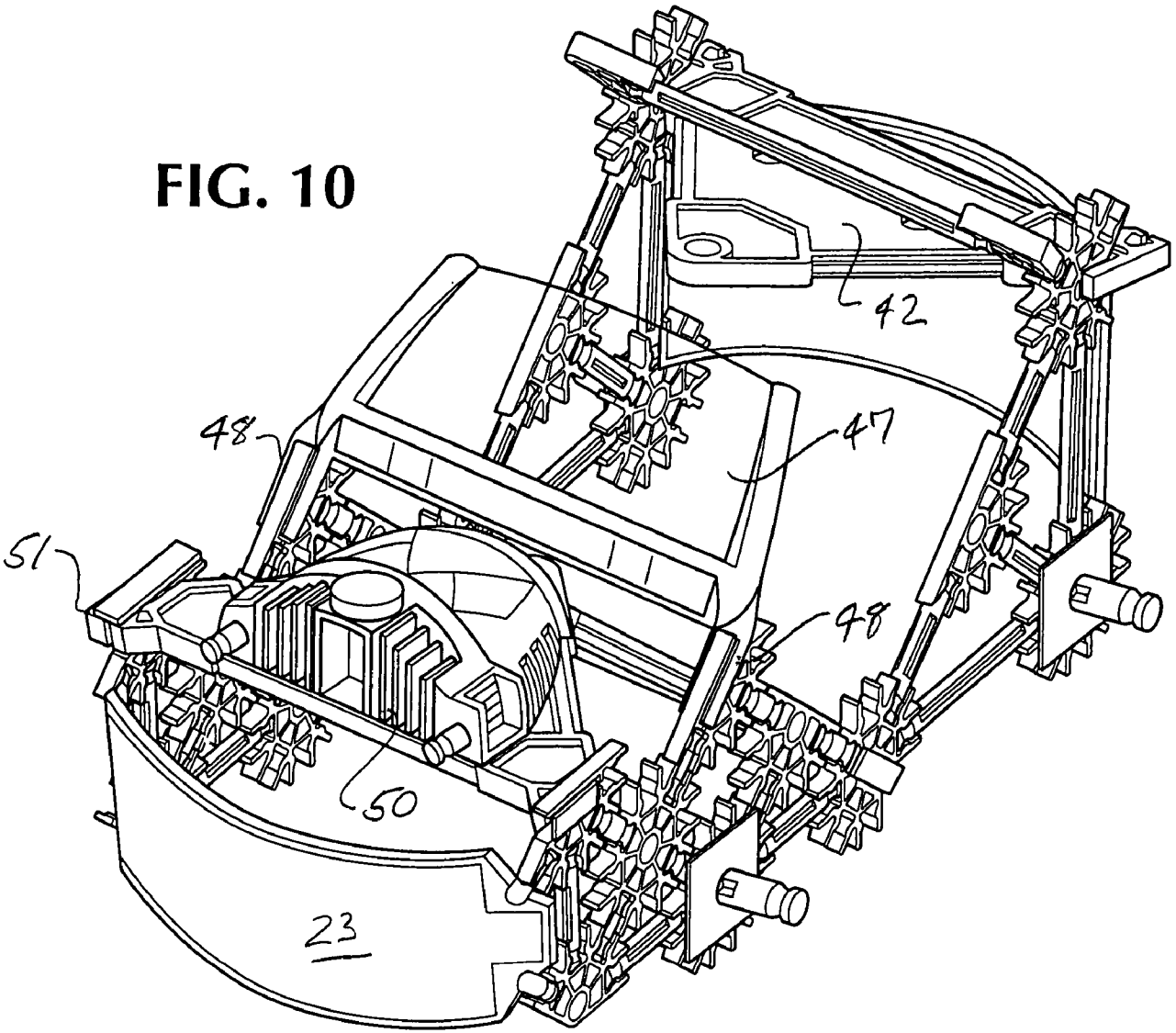
FIG. 10 is a perspective view of the assembly of FIG. 9 after assembly of additional components, including a windshield and simulated engine, for example.

A further rigid bridging element, in the form of a windshield structure (FIG. 10), is provided with recessed arms 48 at each side which are received in upwardly angled recesses 49 in connectors 15, located in the upper mid portions of the subassemblies 21, 22 (FIGS. 2 and 3).

Yet another rigid bridging element 50, this one in the form of a simulated engine unit, is provided with recessed arms 51 at each side for reception in recesses 52 provided in connector elements 15 at the upper forward portions of the subassemblies 21, 22 (FIGS. 2 and 3).

Figure 11:
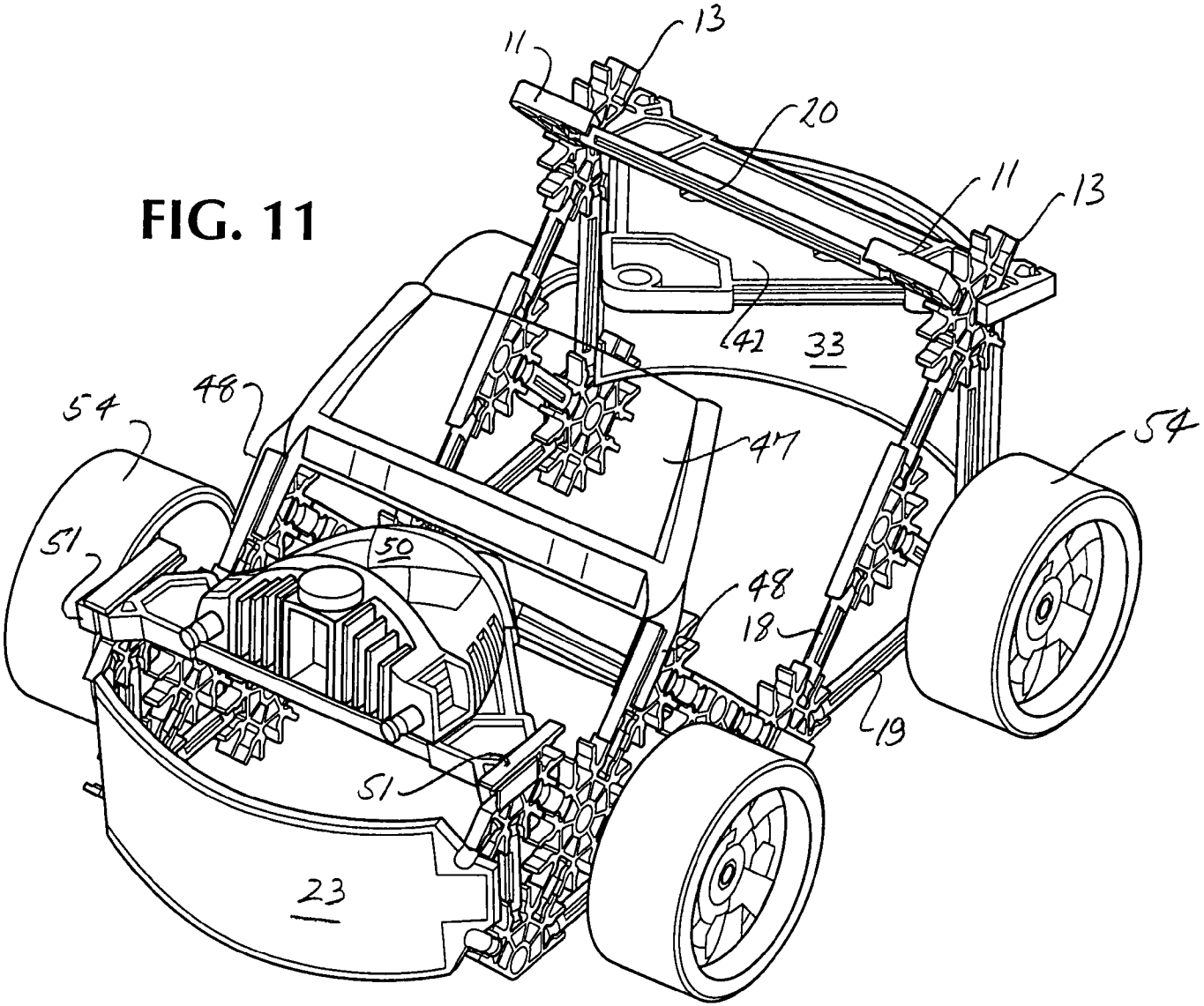
FIG. 11 is a perspective view of the structure of FIG. 10 after the addition of wheels.

The several additional bridging elements installed in the basic structure both rigidify and embellish the structure to a form highly attractive to the builder. As a typical final step in the assembly operation, wheels 54 are applied over the axles 40, the completed structure being shown in FIG. 11. Optionally, the wheels 54, as well as the wheel mounts 38, may be installed during the two-dimensional assembly phase, while the basic structure is still in flat form, inasmuch as the axles and wheels will at that time be positioned above the principal plane of the two-dimensional structure.

The construction procedure of the invention is such that relatively complex structures can be easily and efficiently assembled by young children, who might otherwise have difficulty reconciling the selection, orientation and assembly of components of a three-dimensional structure utilizing typical instructions which involve the builder reading and understanding the instruction steps, on the one hand, and then selecting, orienting and assembling the parts at a separate place, albeit nearby the instructions. In the procedure of the present invention, the majority of the construction takes place in two-dimensional form, on a printed construction plan which illustrates the component parts in full size and in assembled relation, such that the builder has merely to place a part of identical size and shape directly over its illustration on the construction plan and press it into place in relation to a neighboring part. With the system of the invention, the builder is most unlikely to make a construction error, inasmuch as merely placing the part over the image on the construction plan will immediately inform the builder whether it is the correct part or not and whether it is properly oriented.

After the structure is completed in its two-dimensional form, it is easily erected to a three-dimensional form, with opposite sides being connected together to form a basic three-dimensional structure. Thereafter, the structure may be embellished by the addition of other components, particularly bridging components which rigidly connect one side subassembly to the other.

Although in one advantageous form of the invention, flexible bridging elements, preferably flexible panels or flexible rods, are utilized to join one of the opposite side subassemblies to the other, it is foreseen that pivotal, instead of flexible, bridging connections might be made between opposite side subassemblies, somewhat in the nature of the rod 20 and its connector elements 11 (FIGS. 5, 6). Accordingly, the term "reorientable bridging element", as used in the claims hereof, shall include pivoting or hinged connections as well as flexible elements such as flexible rods and panels.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A method for constructing a three-dimensional structure with a multi-part construction toy set having a plurality of component parts which can be joined together in a semi-permanent manner by a lateral snap-together engagement, which comprises (a) providing a flat two-dimensional construction plan illustrating a flat two-dimensional assembly of a plurality of said component parts sufficient to form a substantial portion of said three-dimensional structure, (b) said two-dimensional construction plan including a full-size illustration of said flat two-dimensional assembly, showing the component parts thereof in assembled relation, (c) initially building said flat two-dimensional assembly directly upon said flat two dimensional construction plan by connecting together the component parts illustrated on said construction plan, (d) said flat two-dimensional assembly having opposite end portions and including first and second flat two-dimensional subassemblies, each including respective first and second end portions and said assembly further including a reorientable bridging element positioned between and joining adjacent end portions of said first and second subassemblies in said flat two-dimensional assembly, (e) erecting said two-dimensional assembly to a three-dimensional form, by reorienting said bridging element with respect to the respective subassemblies to bring said subassemblies into spaced apart positions with end portions thereof in generally opposing relation, and (f) connecting said opposite end portions of said reoriented assembly to form a three-dimensional structure.

2. The method of claim 1, wherein (a) said flat two-dimensional structure is constructed to include a pair of opposite side subassemblies of relatively rigid flat construction, (b) said subassemblies are joined by one or more flexible bridging elements, and (c) said bridging elements are flexed when joining said subassemblies.

3. The method of claim 1, wherein (a) said component parts are provided in a multiplicity of colors, and (b) said construction plan illustrates said component parts in the respective colors thereof whereby said flat two-dimensional assembly may be constructed by placing component parts of a given color directly over a corresponding colored illustration of such component part on said construction plan for lateral snap-in engagement.

* * * * *